United States Patent [19]

Harvey

[11] Patent Number: 5,023,957

[45] Date of Patent: Jun. 18, 1991

[54] PANTY HOSE FOR WEARING UNDER AN ABBREVIATED OUTER GARMENT

[76] Inventor: Mary A. Harvey, 2358 Cloister Ct., Troy, Mich. 48084

[21] Appl. No.: 453,786

[22] Filed: Dec. 20, 1990

[51] Int. Cl.[5] ..... A41B 9/04

[52] U.S. Cl. ..... 2/409; 2/406; 66/178 R; 66/177

[58] Field of Search ..... 2/409, 407, 406, 408; 66/177, 176, 178 R

[56] References Cited

U.S. PATENT DOCUMENTS

| | | | |
|---|---|---|---|
| D. 247,368 | 2/1978 | Whitehead | D24/51 |
| 2,651,048 | 9/1953 | Milberg . | |
| 3,097,648 | 7/1963 | Dupuis . | |
| 3,487,473 | 1/1970 | Janhsen | 2/409 |
| 3,555,569 | 1/1971 | Jones | 2/237 |
| 3,815,156 | 6/1974 | Gaither | 2/224 R |
| 3,909,851 | 10/1975 | Garrou et al. | 2/224 R |
| 3,914,799 | 10/1975 | Newmar | 2/224 R |
| 4,400,832 | 8/1983 | Kinder | 2/406 |
| 4,412,433 | 11/1983 | Safrit et al. | 2/409 |
| 4,523,337 | 1/1985 | Leibowitz | 2/237 |
| 4,920,769 | 5/1990 | Rickerl | 2/406 |

FOREIGN PATENT DOCUMENTS

| | | |
|---|---|---|
| 2285088 | 9/1974 | France . |
| 899434 | 8/1959 | United Kingdom . |

*Primary Examiner*—William A. Cuchlinski, Jr.
*Assistant Examiner*—William C. Dowling
*Attorney, Agent, or Firm*—Harness, Dickey & Pierce

[57] ABSTRACT

This invention relates to a panty hose garment worn by a dancer or entertainer who is also wearing a revealing costume such as a G-string. This invention avoids the problem of having to roll down the top edge of the panty hose garment to be hidden underneath the dancer's or entertainer's costume. When the dancer or entertainer puts on the panty hose garment, according to this invention, it is stretched to a point such that the edges of the panty hose garment ride on the dancer's or entertainer's hips. The front slopes down in a V-shaped configuration following the contours of the G-string costume such that the edge is completely concealed by the G-string. The panty hose garment further includes a teardrop shaped crotch panel, such that the edges of the crotch panel do not extend over the edges of the G-string costume.

11 Claims, 3 Drawing Sheets

PANTY HOSE FOR WEARING UNDER AN ABBREVIATED OUTER GARMENT

BACKGROUND OF THE INVENTION

This invention relates to a panty hose garment and more specifically a panty hose garment worn by an entertainer or a dancer wearing an abbreviated article of clothing.

Panty hose garments incorporating a knitted, stretchable material such as nylon are known in the art. These garments are very sheer and when desirable are of a color close to that of human skin. Because of these qualities, entertainers wearing revealing abbreviated costumes, for aesthetics in dance routines or the like, choose to wear a panty hose garment to give various aesthetic effects, such as not having anything covering their lower torso and legs. Many female dancers who perform in abbreviated costumes, such as for instance a G-string costume, choose to or are required to wear a covering of some kind under the G-string. In order to accomplish the desired appearance of human skin and to avoid sagging and other problems which would detract from this appearance, these dancers generally pull the panty hose garment up as high as they can to stretch the garment, eliminating excess material and getting the sheerest appearance possible. Thus, it appears that the dancer is not wearing anything under the G-string, making the show more appealing.

With the prior art panty hose, pulling up and stretching of the panty hose gave a nearly unmanageable amount of material above the G-string costume. The dancer would roll the waistband of the garment down to conform to the G-string costume and pin it underneath the costume so it would not show or come out. This process was time consuming and often resulted in runs or rips in the panty hose material. Thus, the use of prior art panty hose was extremely inconvenient in the entertainment industry where time is often of the essence when changing costumes between routines. There also was a certain amount of aggravation, discomfort, and loss of aesthetics involved with this procedure, since the amount of material placed under the abbreviated costumes was often bulky, detracting from the entertainer's appearance. Thus, on many occasions the dancer's performance was much less appealing from both the dancer's and audience's point of view.

The prior art panty hose garments generally included a crotch panel of a variety of shapes for purposes such as ventilation and comfort. This panel is usually of another material such as cotton or the like and may also be stretchable. For performances incorporating such abbreviated costumes the prior art crotch panel is wider than the costume in that area, and therefore would detract from the appealing aspect of the entertainment. To remove this blemish of aesthetics, entertainers would try to hide the crotch panel under the G-string. Similar to the waistband, the dancer would pin the overlapping edges of the crotch panel underneath the G-string costume so that it would not show. This further added to the aggravation and discomfort of the garment.

SUMMARY OF THE INVENTION

This invention eliminates a number of the problems and drawbacks of the panty hose garments used in the entertainment industry and specifically eliminates the two described above The panty hose garment of the present invention is of a dimension such that when the dancer puts on the garment and pulls it up as far as she can, the waistband rides on the top of her hip bones. Further, the front of the garment slopes down in a general V-shape to a point well below the dancers navel. Such a configuration permits the top edge of the panty hose garment to remain below, and thus concealed by, the top edge of a G-string costume without rolling it down and pinning. Therefore, the dancer need not pin the panty hose garment to the G-string costume.

A further advantage of this invention is the size and shape of the crotch panel. The shape of the crotch panel is generally in a teardrop shape to more nearly conform to the dancer's anatomical shape. The wider end of the teardrop shaped crotch panel is directed towards the front. Further, the crotch panel is of such a width that it covers the dancer's vaginal area without protruding over the edges of the G-string costume. Therefore, the dancer need not pin or tuck the edges of the crotch panel underneath the G-string to make the crotch panel nonvisible.

BRIEF DESCRIPTION OF THE DRAWINGS

The features and advantages of the invention can be more readily realized from the description below and the attached drawings wherein.

DETAILED DESCRIPTION OF THE PREFERRED EMBODIMENT

Figure 1:
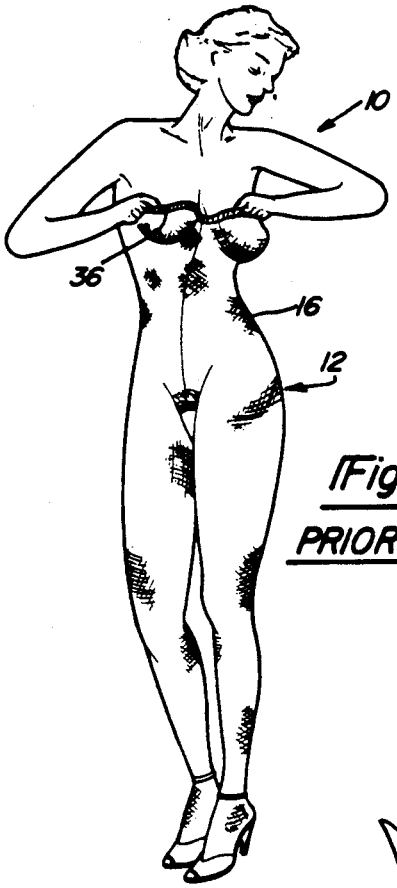
Fig-1 PRIOR ART
FIG. 1 is a perspective view showing an entertainer pulling up a pair of prior art panty hose.

FIG. 1 shows an entertainer or dancer 10 wearing a panty hose garment 12 of the type according to the prior art. These types of panty hose garments are generally made of a finely woven stretchable synthetic material, such as nylon. This material is very sheer and stretchable and is designed to cling to the contours of the wearer. Typically, the waistband 36 of the panty hose garment 12 is meant to ride on top of the hips 16 about the waist of the wearer 10. In general use, the panty hose are commonly worn under dresses or the like where only the legs are visible so the size or shape of the hidden portion is not critical. However, dancers, entertainers, models of swimsuits or underwear and the like are required to wear revealing abbreviated costumes in which it is necessary or desired to wear a panty hose garment underneath, and still give the effect of wearing nothing at all or to accomplish other aesthetic effects wherein the normally unseen portions of the panty hose would be visible unless special precautions are taken. Additionally, it is necessary for these persons to ensure that the garment will conform to all body contours during the various contortions required in choreography of the dance routines. To enhance the appearance and meet these goals, the entertainer is required to pull up and stretch the panty hose garment as far as she can making the waistband 36 come well above her hips, as shown in FIG. 1. This makes the panty hose garment cling to the contours of the entertainer as closely as possible and also makes the panty hose garment as sheer as possible, thus giving more of an appearance of the human shape and human skin color and reduce the possibility of sags or the like during the dance routine.

Figure 2:
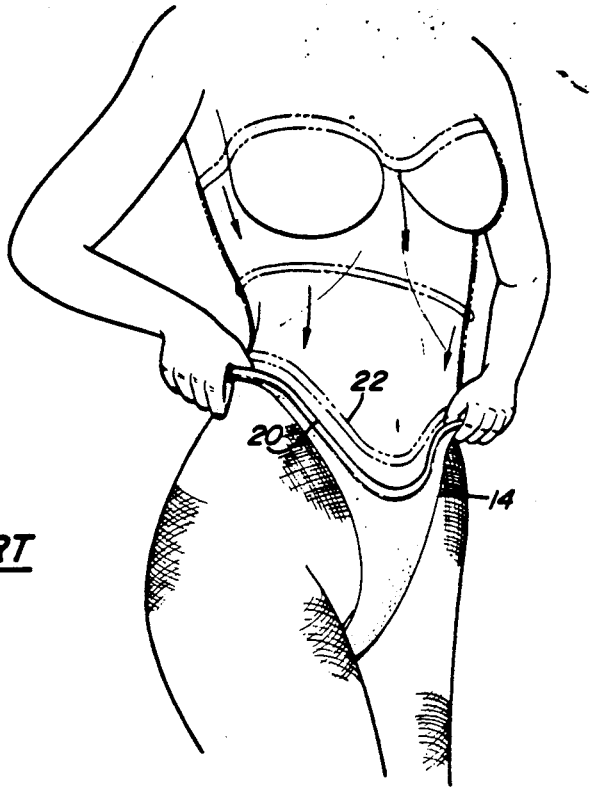
Fig-2 PRIOR ART
FIG. 2 is a detailed perspective view showing the prior art panty hose rolled down relative to an abbreviated costume.

Once the entertainer has pulled up the panty hose garment, she is thereafter required to conceal the unwanted portion of the panty hose garment under her abbreviated costume. To accomplish this the entertainer rolls down the waistband 36 (as shown in phantom) into a rolled edge portion 22 as can be best seen in FIG. 2. The waistband 36 is rolled down far enough such that it does not protrude over the top edge of the waistband 20 of the costume, such as a G-string costume 14 shown here. As also can be seen by FIG. 2, the rolled edge portion 22 of the panty hose garment 12 must be pinned in order to follow the contour of the top edge of the waistband 20 of the costume 14.

Figure 3:
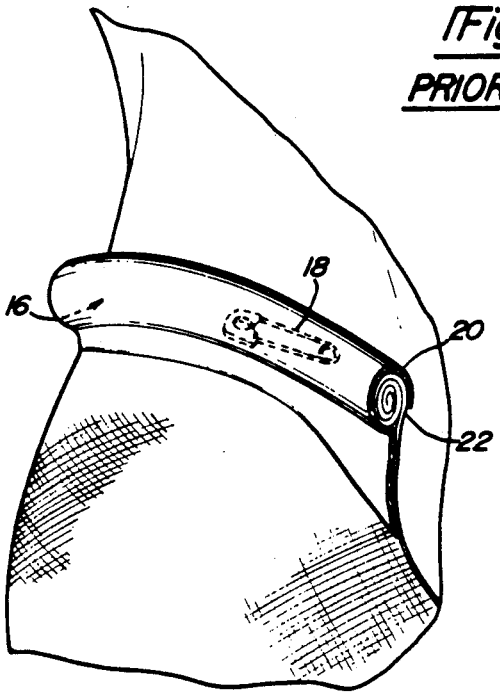
Fig-3 PRIOR ART
FIG. 3 is a detailed perspective view showing the rolled down portion of the prior art panty hose pinned to the inside of the waistband of an abbreviated costume.

Once the waistband 36 of the panty hose garment 12 is rolled down into rolled edge portion 22, it is secured to the inside of the costume 14 to remain in the desired location. FIG. 3 shows one method of securing this edge portion. As can be seen, rolled edge portion 22 is rolled down below top edge 20 of costume 14. The waistband 20 of costume 14 is then rolled over edge portion 22 and secured there by adequate means such as a plurality of safety pins 18.

Figure 4:
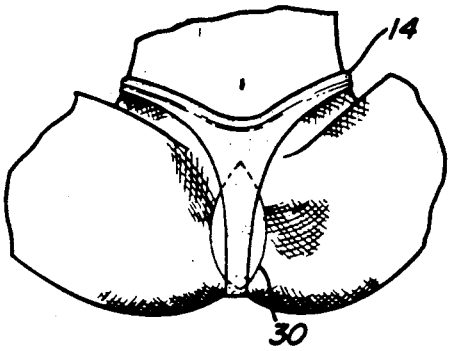
Fig-4 PRIOR ART
FIG. 4 is a detailed perspective view showing the crotch panel of the prior art panty hose extending over the edges of a G-string costume on a dancer.

FIG. 4 shows a typical crotch panel 30 of the prior art panty hose garment 12. In this figure, crotch panel 30 is shown relative to a typical G-string type abbreviated costume 14. Rolled edge portion 22 of the panty hose garment 12 has already been secured to the inside of edge 20 of the G-string costume 14 by safety pin 18. It can be seen that a substantial amount of the edge portions of crotch panel 30 extend over the adjacent portion of the G-string costume. For many dancers, entertainers and models this provides a number of problems in that this overlapping edge portion of crotch panel 30 again needs to be secured under the G-string costume 14 such that it cannot be seen. Because of the relative bulk of these pads and the relative narrow width of the costume at the crotch area, the resulting appearance, after attempting to reduce the size of the pad by folding and pinning of the pad, is extremely bulky and detracts from the aesthetic appearance of the entertainer.

Figure 5:
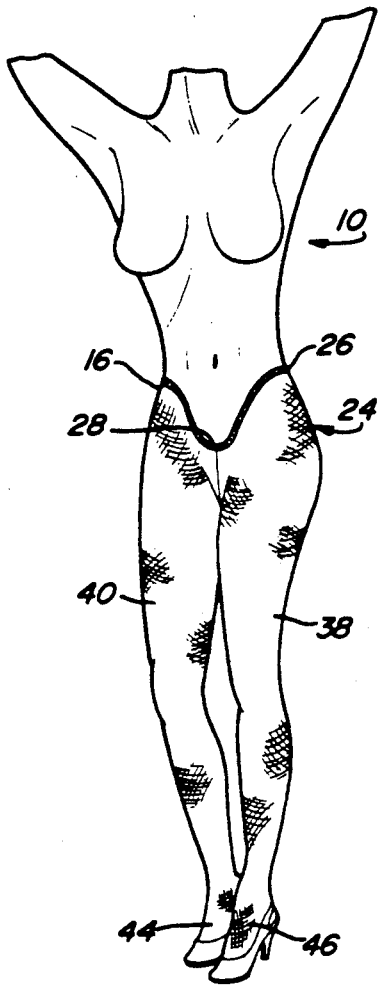
FIG. 5 is a perspective view of an entertainer wearing a panty hose garment made in accordance with the teachings of the present invention.

Now turning to FIG. 5, panty hose garment 24 of the preferred embodiment of this invention is shown covering the legs and lower torso of a dancer or entertainer. Panty hose garment 24 includes two leg portions 38, 40 connected to an upper panty portion 42 around the lower torso of the entertainer 10. The panty hose garment 24 will generally have feet portions 44, 46 at its lower end and a waistband 26 at its upper end. The waistband 26 of the preferred embodiment follows a general V-shape in both the back and the front of the panty portion 42. Also included with the garment 24 is a teardrop shaped crotch panel 32 adjacent the wearer's vaginal area. The waistband 26 is usually of a width between one half inch to two inches. The panty hose garment 24 itself can come in a variety of different styles, colors and sizes, as is well known in the art.

When the dancer 10 pulls up panty hose garment 24 as far as she can without ruining the garment, it stretches to a point such that the waistband 26 rides on the dancer's hips 16 at sides of the dancer's waist region. As can be seen, the front portion of the waistband 26 of the panty hose garment 24 slopes down to a point 28 intermediate the dancer's or entertainer's navel and crotch area.

Figure 6:
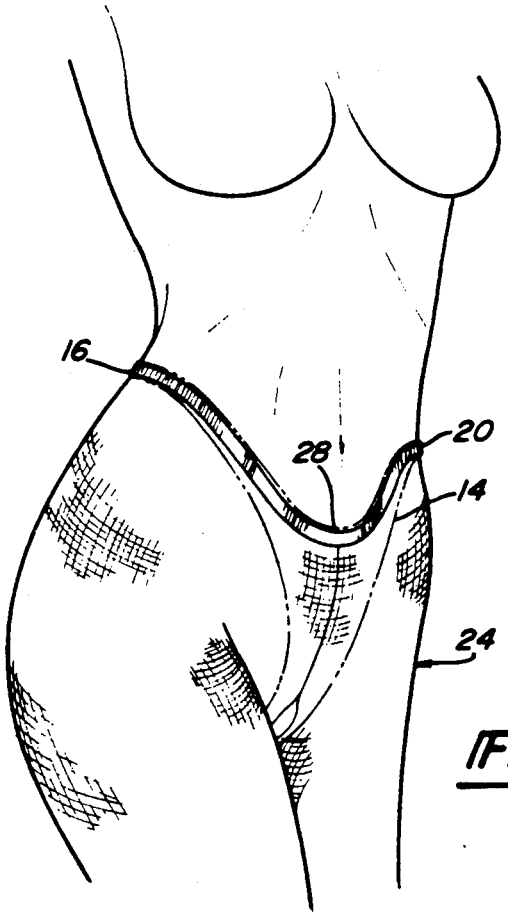
FIG. 6 is a perspective view of an entertainer wearing the panty hose garment of the present invention and showing typical abbreviated costume in phantom.

FIG. 6 shows the dancer or entertainer 10 wearing the pant hose garment 24 according to this invention and also a typical G-string costume 14. As can be seen, the waistband 26 of panty hose garment 24 generally follows the contours of the waistband 20 of the G-string costume 14 such that waistband 26 is completely hidden by it. This eliminates the need to secure the panty hose garment and costume together, since the upper edge of the panty hose garment 24 will be concealed entirely by G-string costume 14.

Figure 7:
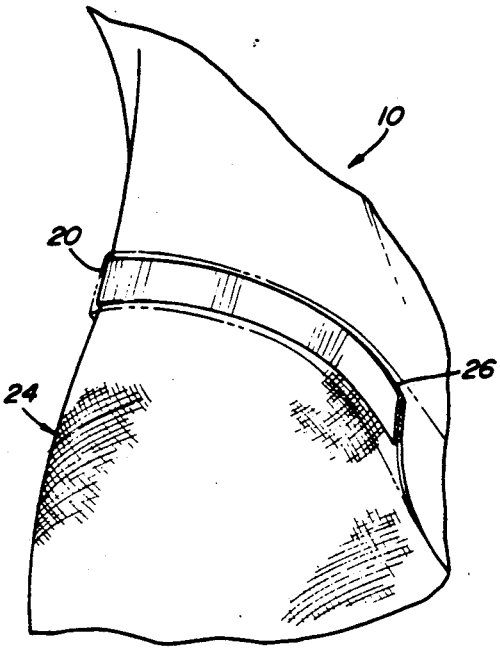
FIG. 7 is a detailed perspective view, partially broken away, showing the waistband of the panty hose garment made in accordance with the teachings of the present invention.

FIG. 7 shows a detailed view of the two waistbands 26 and 20 of the panty hose garment 24 and G-string costume 14, respectively. As can be seen, waistband 26 follows waistband 20 and is completely hidden by it. The waistband 20 of the panty hose garment 24 has not been rolled or formed to conform with the contour of waistband 26.

Figure 8:
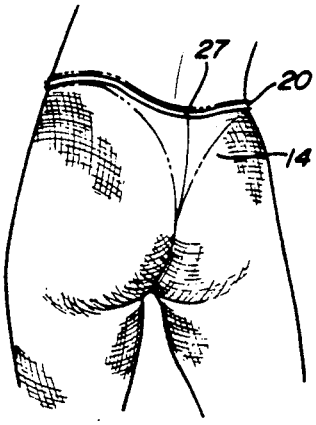
FIG. 8 is a detailed perspective view of the panty hose garment made in accordance with the teachings of the present invention as worn by an entertainer and showing a typical abbreviated costume in phantom.

Now turning to FIG. 8, it can be seen that the rear portion contour of the waistband 26 of the panty hose garment 24 follows the contour of the waistband 20 of the G-string costume 14. This contour will also slope towards the middle to point 27.

Figure 9:
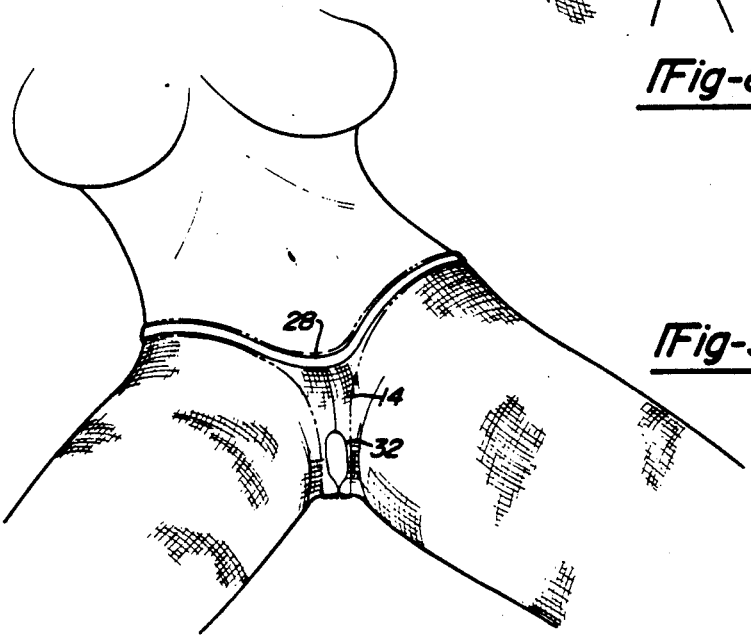
FIG. 9 is a detailed perspective view showing the crotch panel of the panty hose garment made in accordance with the teachings of the present invention showing a typical costume in phantom.

FIG. 9 shows a crotch panel 32 according to the preferred embodiment of this invention included with the panty hose garment 24. Crotch panel 32 is usually made of a separate material from the panty hose garment 24, such as cotton. As can be seen, crotch panel 32 is of such a size to be completely covered by a typical G-string costume 14 and still cover the vaginal area of the entertainer or dancer.

Figure 10:
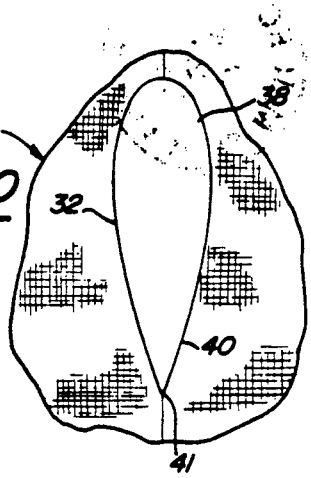
FIG. 10 is a detailed plan view of a crotch panel made in accordance with the teachings of the present invention.

FIG. 10 shows in detail the crotch panel 32 according to the preferred embodiment of this invention. As can be seen, it is generally in a teardrop shape. The wider end 38 of the teardrop shaped crotch panel 32 is towards the front of the dancer or entertainer and thus, the pointed end 40 is towards the back. The crotch panel is designed such that the wider portion is just wide enough to cover the labia area of the female torso and the tapering portion will cover the anus area and will terminate shortly thereafter. The entire length of the crotch panel 32 is typically from about four to about eight inches long and preferably about six inches long. It is generally from about one half to about two inches wide at its widest point and is preferably about one and one half inches wide. Its widest point tely 25% of the length of the crotch panel on the wider portion from the pointed end.

It slopes to a width approximately one inch wide at about 75% its length and thereafter tapers to the pointed end 41. The one inch width is approximately one and one half inches from the pointed end. From the size and configuration of the crotch panel 32, the appropriate areas of the dancer are covered without the panel showing over the edges of the G-string costume 14.

In a preferred embodiment of the present invention the wider end 38 is spaced from teh apex 28 of the V-shaped waistband in the front at a distance of from about four to about eight inches and preferably about six inches when the material is fully stretched. The point end 41 of the crotch panel is spaced from the rear apex 27 of the waistband 26 from about eight to about fourteen inches and preferably about twelve inches in the fully stretched position.

The preferred embodiment of this invention has been described above. However, alterations or modifications can be made to this invention without departing from the spirit and scope of the invention as described in the following claims.

What is claimed is:

1. A one-piece panty hose garment of a sheer, knitted, stretchable material comprising:

leg and torso portions generally of the shape of a wearer;

a tear drop shaped crotch panel having a maximum width of two inches at its widest point; and an elastic waistband, said waistband having side portions which will ride on the wearer's hips, a back portion and a front portion which slopes down in a V-shaped configuration to a point substantially below the wearer's navel, said point below the wearer's navel being substantially below the lowest point of the back portion, said waistband having a width which is readily concealable under a G-string type garment.

2. The garment of claim 1 wherein the waistband has a back portion which slopes down in a V-shape configuration.

3. The garment of claim 1 wherein the crotch panel is about one and one half inches wide at its widest portion, and slopes to a width of approximately one inch wide.

4. The garment of claim 1 wherein the crotch panel is about six inches long.

5. A panty hose garment for wearing over the legs and lower torso area of a wearer and made from a stretchable, sheer material such that when the wearer puts on the garment it will ride on top of the wearer's hips and be stretched so the wearer's skin is clearly visible, through the material, said panty hose garment comprising:

a panty portion including a crotch portion, a front portion and a back portion substantially enclosing the wearer's lower torso area between the wearer's hips and crotch;

two leg portions extending from both sides of the crotch portion;

a waistband completely encircling the upper edge of the panty portion and having a width which is readily concealable under a G-string type garment, said waistband having a V-shaped configuration across the front portion of the panty portion such that the waistband is supported by the wearer's hips and falls substantially below the wearer's navel at the apex of the V, and the apex of the V-shape front portion falling substantially below the lowest point of the back portion; and a crotch panel within the crotch portion, said crotch panel having a teardrop shape such that the wider end of the crotch panel is towards the front portion of the panty hose garment.

6. The panty hose garment of claim 5 wherein the waistband further comprises a V-shaped configuration across the back portion.

7. The panty hose garment of claim 5 wherein the crotch panel is about two inches wide at its widest portion.

8. The panty hose garment of claim 5 wherein the crotch panel is approximately six inches long.

9. A panty hose garment for wearing on the human torso and providing for reduced visibility when worn under an abbreviated article of clothing having reduced dimensions in the crotch area and about the hip bones and below the navel of a wearer; said panty hose garment of the type including a lower torso covering portion having a panty portion including a front, a back and two sides, a waistband and a crotch portion and a pair of leg portions extending therefrom on either side of said crotch portions, the torso covering portion being made of a sheer stretchable material having a predetermine elongation stretch limit and the crotch panel portion including a crotch panel insert made of a separate fabric material, the improvement comprising:

said waistband of the panty portion having a width of from about one half inch to about two inches for being readily concealable under an abbreviated garment without pinning or rolling of the waistband, said waistband including a V-shaped frontal contour forming a downward point apex wherein the apex of the V-shape falls below the navel of the torso and the upper limit of the V-shaped waistband is adjacent the sides of the panty portion and traverses the hip bones oft he torso and the waistband further includes a substantially lesser V-shape at the back portion when said garment is stretched onto the torso of the wearer to its stretch limit capabilities; and said crotch panel is a teardrop shaped crotch panel which includes a frontal wider portion and tapers to a rear pointed portion, said frontal portion being of a size for substantially covering the vaginal area of the torso and covering the anal area and being less than the widest diameter of the abbreviated article of clothing at the crotch area.

10. The panty hose garment of claim 9 wherein the apex of the V-shape is spaced from about four to about six inches from the crotch panel.

11. The panty hose garment of claim 9 wherein the lesser V-shaped waistband in the rear of the garment forms a second downwardly extending apex and the pointed end of the crotch panel is spaced from the second apex at a distance of from about eight to about fourteen inches.

* * * * *